US009889966B2

(12) United States Patent
Medeiros et al.

(10) Patent No.: US 9,889,966 B2
(45) Date of Patent: Feb. 13, 2018

(54) VENTED CONTAINER FOR VISCOUS LIQUIDS

(71) Applicant: The Procter & Gamble Company, Cincinnati, OH (US)

(72) Inventors: Franco Silva Medeiros, Loveland, OH (US); Ralph Albert Sagel, Loveland, OH (US); Raymond Charles Bell, Cincinnati, OH (US); Christopher Lawrence Smith, Liberty Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/493,726

(22) Filed: Sep. 23, 2014

(65) Prior Publication Data

US 2015/0083759 A1 Mar. 26, 2015

Related U.S. Application Data

(60) Provisional application No. 61/881,647, filed on Sep. 24, 2013.

(51) Int. Cl.

| | |
|---|---|
| ***B05B 11/00*** | (2006.01) |
| ***B65D 23/02*** | (2006.01) |
| ***B65D 47/20*** | (2006.01) |
| ***B65D 47/32*** | (2006.01) |

(52) U.S. Cl.

CPC ..... *B65D 23/02* (2013.01); *B65D 47/2018* (2013.01); *B65D 47/32* (2013.01)

(58) Field of Classification Search

CPC ..... B05B 11/0016; B05B 11/0018; B05B 11/0021; B65D 47/2081; B65D 47/2018; B65D 47/32; B65D 23/02; B65D 47/2031; B65D 47/205

USPC ..... 222/212, 207, 211, 213, 215, 556, 494, 222/321.2

See application file for complete search history.

(56) References Cited

U.S. PATENT DOCUMENTS

| | | | | |
|---|---|---|---|---|
| 3,179,290 | A * | 4/1965 | Whitney | B65D 47/40 222/571 |
| 3,221,945 | A * | 12/1965 | Davis, Jr. | 222/633 |
| 4,222,504 | A * | 9/1980 | Ackerman | B65D 23/065 222/569 |
| 4,513,891 | A * | 4/1985 | Hain et al. | 222/213 |
| 4,646,945 | A * | 3/1987 | Steiner et al. | 222/207 |
| 5,238,153 | A * | 8/1993 | Castillo et al. | 222/189.09 |
| 5,240,149 | A * | 8/1993 | Schmidt | 222/212 |
| 5,310,112 | A * | 5/1994 | Meshberg | B05B 11/0018 137/493.8 |
| 5,472,122 | A * | 12/1995 | Appleby | 222/212 |

(Continued)

FOREIGN PATENT DOCUMENTS

JP H08113244 5/1996

OTHER PUBLICATIONS

International Search Report and Written Opinion, dated Feb. 5, 2015; 15 pages.

(Continued)

*Primary Examiner* — Charles P Cheyney
(74) *Attorney, Agent, or Firm* — Parker D. McCrary; James E. Oehlenschlager

(57) ABSTRACT

A container for the storage and dispensing of viscous liquids having an opening with a valve, a vent, and a modified inner surface.

11 Claims, 11 Drawing Sheets

(56) References Cited

U.S. PATENT DOCUMENTS 5,988,448 A * 11/1999 Foth ..... B65D 47/243 222/189.09
6,062,436 A * 5/2000 Fuchs ..... B65D 47/2031 137/846
6,367,668 B1 4/2002 Schwanenberg
6,378,742 B1 * 4/2002 Rohr et al. ..... 222/494
6,604,693 B2 * 8/2003 Santagiuliana ..... 239/343
6,629,624 B2 * 10/2003 Stillinger et al. ..... 220/714
6,832,706 B2 * 12/2004 Hearld ..... B65D 47/0828 222/482
6,874,656 B2 * 4/2005 Rohr et al. ..... 222/1
6,951,295 B1 * 10/2005 Gaus et al. ..... 222/484
7,070,065 B2 * 7/2006 Wong ..... A47G 19/2266 220/714
7,874,467 B2 * 1/2011 Pardes ..... A61F 9/0008 137/853
8,003,178 B2 * 8/2011 Kim et al. ..... 428/35.7
8,141,730 B2 * 3/2012 Smith ..... B65D 51/2864 206/0.5
8,919,608 B2 * 12/2014 Smith ..... B65D 1/32 137/512.4
9,376,241 B2 * 6/2016 Heipp ..... B65D 47/2031
2002/0121525 A1 * 9/2002 Stillinger ..... B65D 47/2025 220/705
2003/0096083 A1 * 5/2003 Morgan ..... B05D 5/08 428/141
2004/0112920 A1 * 6/2004 Felten ..... B65D 47/2081 222/212
2005/0139611 A1 * 6/2005 Kubo ..... B65D 47/06 222/189.06
2007/0051755 A1 3/2007 Foster et al.
2013/0003751 A1 1/2013 Huse
2013/0233869 A1 9/2013 Rios

OTHER PUBLICATIONS

Nancy W. Stauffer: "Novel slippery surfaces: Improving steam turbines and ketchup bottles", MIT Energy Initiative, Jun. 20, 2013 (Jun. 20, 2013). pp. 1-3, XPO55160913, Retrieved from the Internet: URL:http://mitei.mit.edu/news/novel-slippery-surfaces-improving-steam-turbines-and-ketchup-bottles[retrieved on Jan. 9, 2015] the whole document.

* cited by examiner

VENTED CONTAINER FOR VISCOUS LIQUIDS

FIELD OF THE INVENTION

The invention generally relates to vented containers, such as bottles, for the storage of viscous liquids, wherein the inner surface of a bottle improves the amount of material dispensed from the bottle.

BACKGROUND OF THE INVENTION

Squeeze containers are widely known and used for containing and dispensing a wide variety of viscous liquid products, such as body lotions. Squeeze containers typically have a flat base adapted for resting the container in an "upright" orientation that is substantially opposite of the dispensing orientation, in which the squeeze container is actually used. In the upright orientation the viscous product rests on the base within the container and air is trapped in the head space between the viscous product and the cap. To dispense the viscous product, the squeeze container is first inverted from its upright position wherein the viscous product and the air exchange places, such that the viscous product flows toward the opening of the container under the force of gravity, thereby displacing the air to a position between the viscous product and the base of the container. A user opens the cap and squeezes the container to reduce the interior volume of the package, thereby forcing the viscous product out of the cap. When finished dispensing, the user releases pressure and reorients the package in the upright position, such that the remaining viscous product flows back toward the base of the container and "replacement" air is permitted to vent through the discharge opening and into the container, thereby normalizing the atmospheric pressure in the container to permit the sidewall to recover its original shape. Thereafter, the cap is sealed until the next use. The fresh air is termed "replacement" air because it replaces or compensates for the displacement and lost volume of the viscous product. One disadvantage with such a dispensing container is that it is not continuously ready for immediate dispensing of the viscous product.

Squeeze containers, such as squeeze bottles, are becoming increasingly popular for dispensing viscous products, like liquid soap and shampoo. Squeeze bottles can be sleekly styled dispensing packages, which in certain styles do not include a flat base capable of supporting the bottle in an upright position; rather the bottle's cap provides a flat surface for support. A cap includes a flat end adapted for resting the bottle in an orientation that is substantially the same as its intended dispensing orientation. In its normal dispensing orientation, and with the cap in a sealed position, the viscous product rests next to the dispensing cap, and a head of air is trapped between the viscous product and the end wall of the bottle. One advantage of such a dispensing package is that the viscous product contained therein is generally immediately adjacent the dispensing opening, and is thus continuously ready for quick dispensing without having to invert the bottle. To dispense the viscous product, a user opens the cap and squeezes the bottle to reduce the interior volume, thereby forcing the viscous product out of the dispensing opening. When finished, the user releases the pressure, seals the cap, and rests the squeeze bottle on the flat base of the cap until the next use.

Unfortunately, however, the typical squeeze bottle does not readily permit venting of a fresh supply of replacement air in between uses or replacement air becomes trapped between the viscous product and the dispensing opening. This trapped air becomes a bubble making it more difficult for a user to dispense the product, as a user must first squeeze the bottle to expel the trapped air then squeeze again to actually dispense the product.

Further, due to the viscous nature of certain products, such as toothpastes, shampoos, comestibles, paints, lotions, cosmetics, or cleaning products, a residual amount may be left in the ends, along the sides, or edges of a bottle during normal use. In many cases, due to the particular shape of the bottle, a consumer is unable to dispense such residual product. This unused, residual product is often disposed of along with the bottle.

The bottle can be redesigned to improve product evacuation, but such redesigns can be costly and may not result in a significant decrease in the amount of residual product left in the bottle after normal use. For example, product release from a bottle can, in some cases, be improved by modifying the bottle shape or geometry to have shoulder portions that minimize the amount of residual product that remains in such areas. However, redesigning a bottle shape is costly, as new molds are typically required.

Other attempts to improve product release involve modifying the inner surface of the bottles. The entire bottle inner surface may be corona or plasma treated to modify the surface energy/wetting tension ability of the bottle material or a release coating may be applied to the inner surface of the bottle to provide a surface that the product may more easily release from.

Accordingly, there is a desire for a bottle that allows for improved product application while reducing the amount of unused residual product.

SUMMARY OF THE INVENTION

A container having a body having an end wall, side wall, and finished portion forming an inner cavity having an inner surface; a dispensing cap having a cap lid, a dispensing outlet and a vent opening; an outlet valve arrangement; and wherein the inner surface is modified to reduce adhesion between the inner surface and a viscous liquid.

A container having a body having an end wall, side wall, and finished portion forming an inner cavity having an inner surface; a dispensing cap having a cap lid, a dispensing outlet and air channel opening; an outlet valve having an outlet valve flap and a flexible outlet valve retainer ring having an outlet valve retainer ring opening; wherein the inner surface is modified to reduce adhesion between the inner surface and a viscous liquid.

A method of dispensing a viscous liquid comprising providing a container having a body having an end wall, side wall, and finished portion forming an inner cavity having an inner surface; a dispensing cap having a cap lid, a dispensing outlet and a vent opening; an outlet valve having an outlet valve flap and an outlet valve retainer ring having an outlet valve retainer ring opening; viscous liquid; wherein the inner surface is modified to reduce adhesion between the inner surface and a viscous liquid; applying pressure to the bottle to open the valve flap and dispense the viscous liquid; releasing the pressure and closing the valve flap; and drawing replacement air through the vent opening.

DETAILED DESCRIPTION OF THE INVENTION

The present invention is directed to a bottle having a viscous liquid disposed therein. The bottle has a modified inner surface that reduces the amount of residual viscous liquid attached to the inner surface of the bottle. Such modifications may take the form of anti-adherence compositions that reduce the adherence of viscous liquids to the inner surface allowing for most of the viscous liquid to be expelled from the bottle. The anti-adherence compositions may be coated on the inner surface or incorporated in the bottle or both. Further in place of a normal flat surface the inner surface of the bottle may have three-dimensional structure, reducing the surface contact area between the viscous liquid and the inner surface. A bottle also includes a valve and one or more vents that allow for air intake to equalize pressure within the bottle after dispensing a viscous liquid. A vent is positioned below the fluid level, such as in the cap, and in proximity to the bottle wall. This positioning allows the air introduced by the vent to travel along the bottle inner surface to the head space. Such travel along the inner surface is possible due to the inner surface modifications.

For purposes herein, a "viscous" liquid, substance, or product generally refers to a material, in certain embodiments, having a viscosity greater than about 5,000 cp, greater than about 100,000 cp, or greater than about 200,000 cp. Viscosity is measured using a Brookfield viscometer with a spindle appropriate for the material at room temperatures; however, other methods and equipment may also be used to determine viscosity as needed. Examples of viscous products suitable for use in the bottles described herein, include but are not limited to, toothpaste, shampoo, comestibles, paints, coatings, dyes, cosmetics, lotions, pastes, ointments, pharmaceuticals, adhesives, and the like. As also used herein, "normal use" of a bottle means evacuation of the viscous product through the bottle opening without using a supplementary utensil, such as a knife or spoon, to scrape interior surfaces of the bottle to remove residual product. Normal use generally involves dispensing the viscous product from the bottle by pouring, squeezing, shaking, hitting, pounding, or any combination of such actions.

Figure 1:
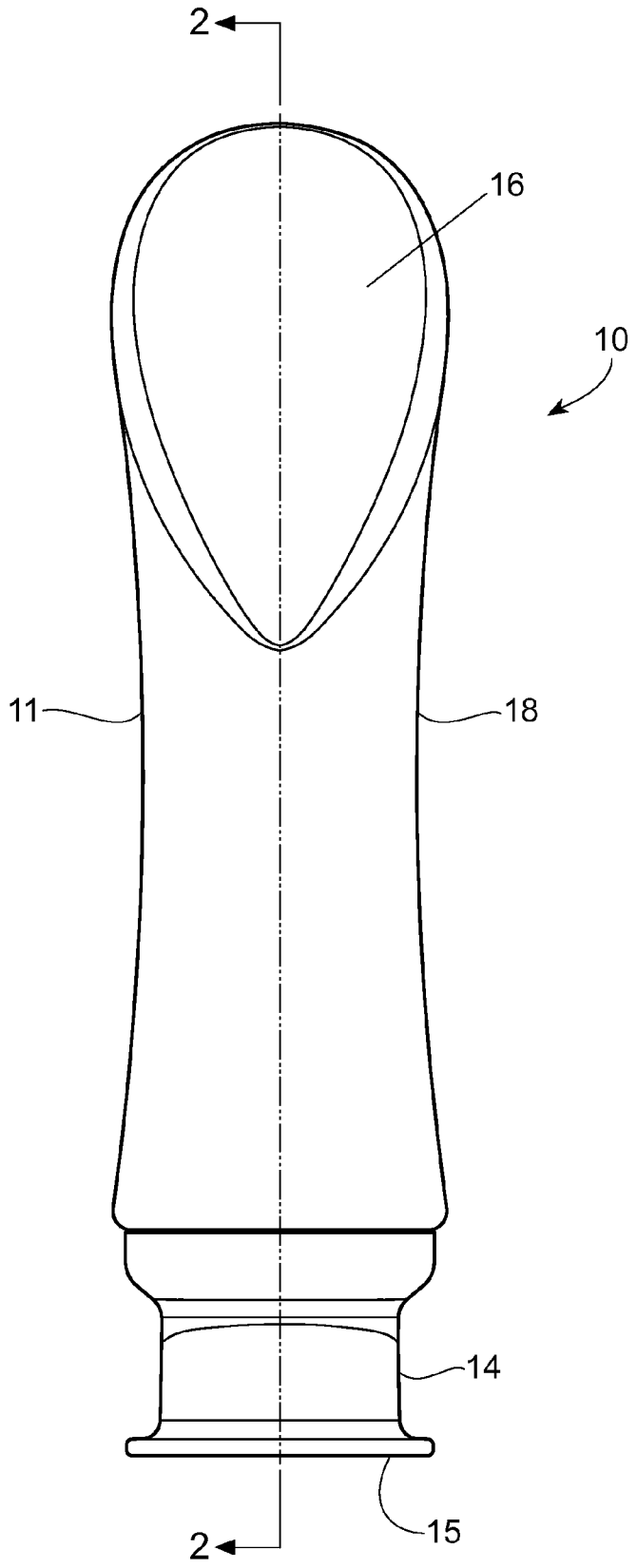
FIG. 1 is a perspective view of a bottle according to an embodiment of the present invention.
Figure 2:
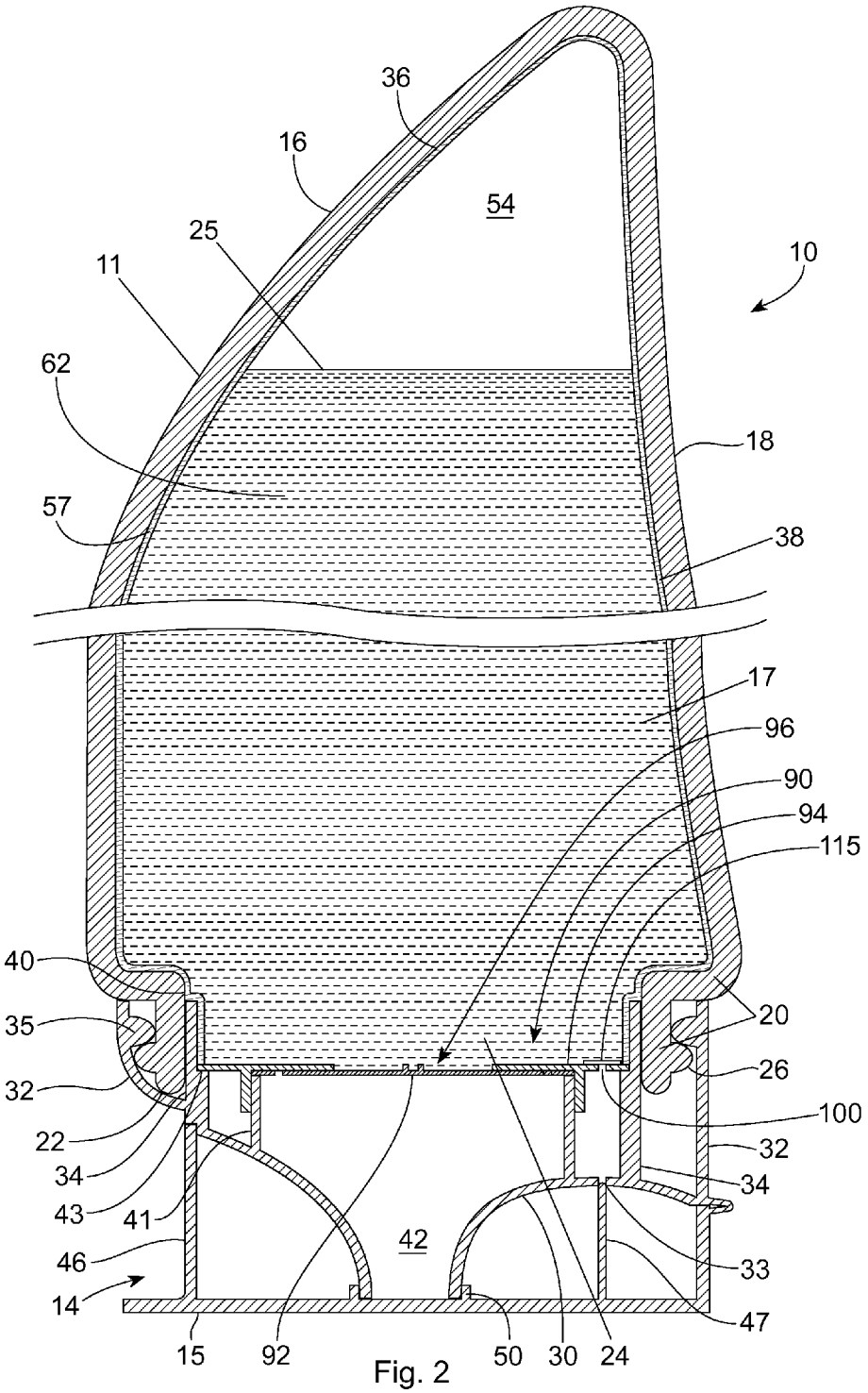
FIG. 2 is a partial longitudinal cross-sectional view of the bottle of FIG. 1 taken substantially along line 2-2 thereof.

FIGS. 1 and 2 illustrate a container 10 embodiment of the present invention for dispensing a viscous liquid 62. The container 10, more specifically, a bottle 10 including a body 11 and a dispensing cap 14 attached thereto, wherein the dispensing cap 14 includes a flat surface 15 for resting the bottle 10 on a surface. The body is flexible to an extent that it may deform in response to pressure differences arising between the inside of said body and the ambient pressure. The body 11 may be composed of a light weight flexible resilient material, such as polypropylene (PP), low density polyethylene (LDPE), high density polyethylene (HDPE), polyethylene terepthalate (PET) or the like, and may be produced by any desired method including blow molding a preform, blow molding an extruded parison or the like. The material may be white, transparent, opaque transparent, translucent, or colored. The body 11 includes an end wall 16 and a sidewall 18 extending away from the end wall 16, defining an inner cavity 17 for containing the viscous liquid 62 therein. As shown in FIG. 2, with such filling configuration, a head space 54 is formed between the viscous liquid 62 upper surface 25 and the end wall 16 of the body 11. The headspace 54 is a portion of the inner cavity 17 that is generally free of or not filled with the viscous liquid 62. As best shown in FIG. 2, the side wall 18 terminates in a finish portion 20 that includes a transverse end 22 defining an opening 24 into the inner cavity 17 of the body 11. Each of the side wall 18, end wall 16, and finish portion 20 has an inner surface 38, 36, and 40, respectively. The finish portion 20 also includes an attachment portion 26, which as shown in FIG. 2 may be a snap bead, but which may be any attachment means known in the art, such as a threaded arrangement, welding, or gluing, for engaging the dispensing cap 14.

It should be appreciated that the figures only schematically illustrate the body 11, and the body 11 may be formed from a variety of different shapes, sizes, configurations, and materials. In one example, a suitable body has a height of about 18 cm, a width of about 3 cm to about 5 cm, and a depth of about 3 cm to about 5 cm.

In addition, while this embodiment is shown in a vertical position the invention also works when a bottle is in a horizontal position. Further, in certain embodiments bottles do not include a flat end wall capable of supporting the bottle in an upright position, which is known as a bottle.

Figure 3:
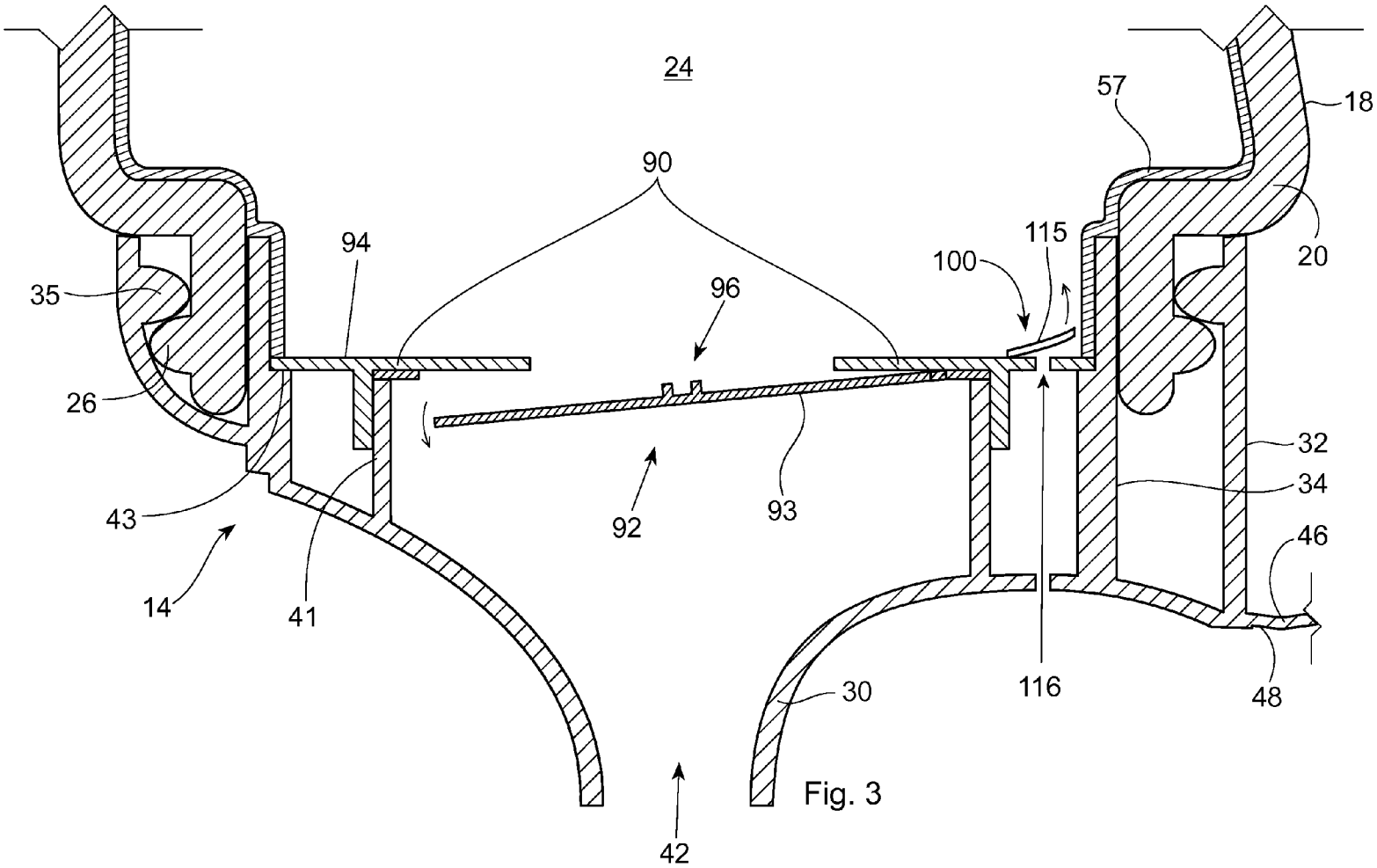
FIG. 3 is a close-up longitudinal cross-sectional view of a dispensing valved cap and vent according to FIG. 1 taken substantially along line 2-2 thereof, but with the cap open.
Figure 4:
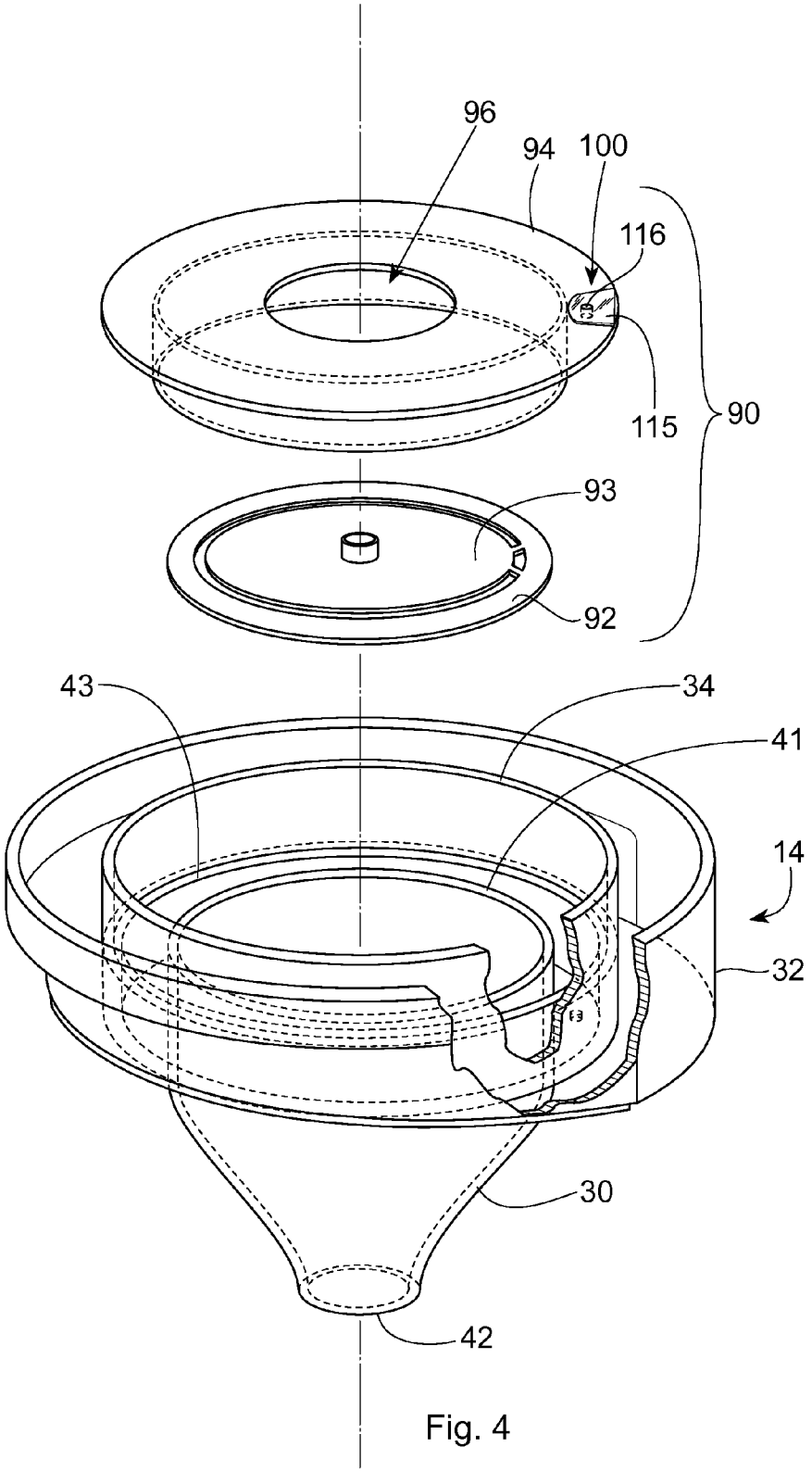
FIG. 4 is an exploded view of a dispensing valved cap and vent according to an embodiment of the present invention.
Figure 5A:
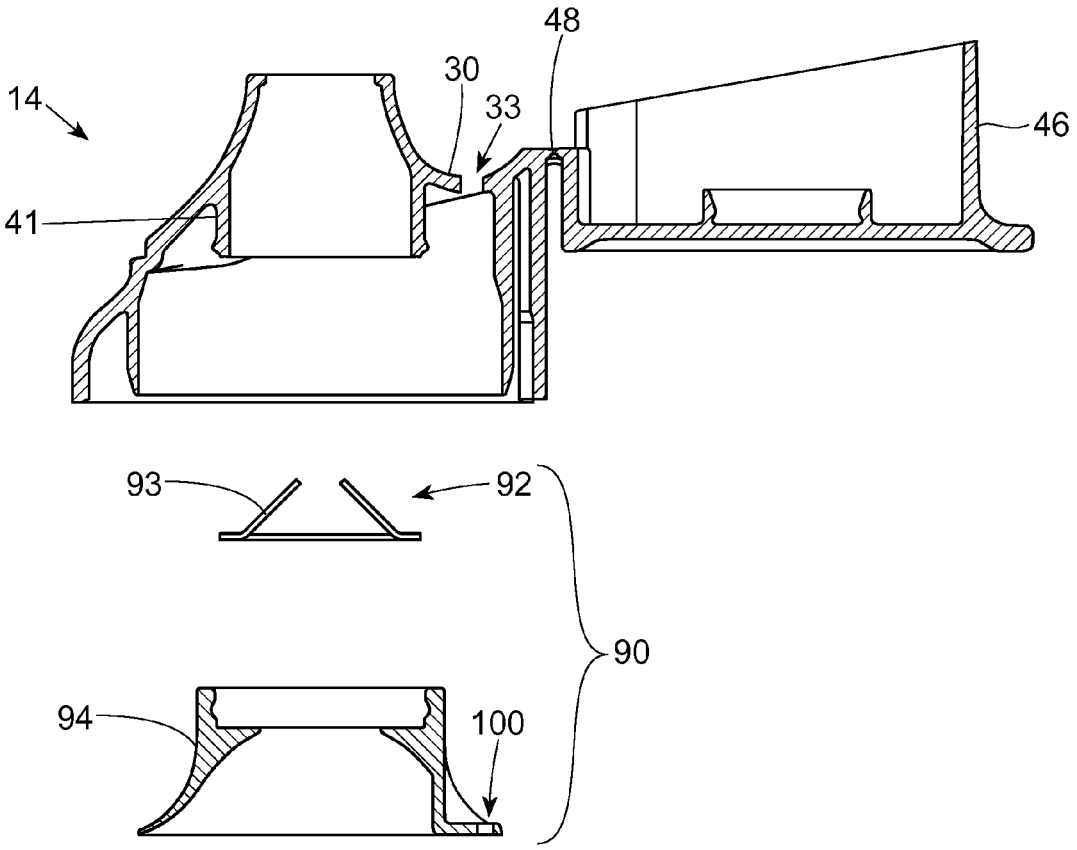
FIG. 5A is an exploded cross-sectional view of a dispensing valved cap and vent according to an embodiment of the present invention.
Figure 5B:
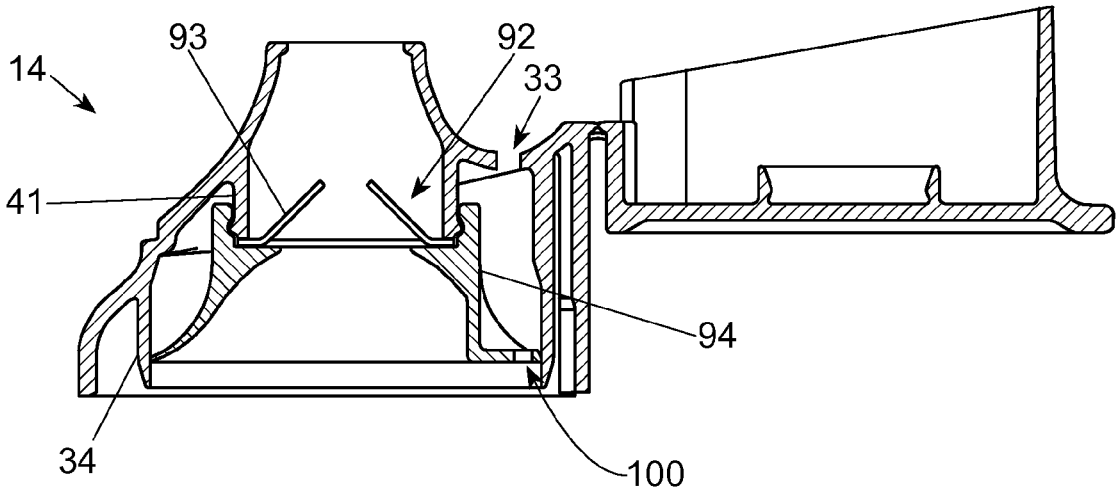
FIG. 5B is a cross-sectional view of a dispensing valved cap according to an embodiment of the present invention.

As shown in FIGS. 2, 3 and 4, in certain embodiments, dispensing cap 14 is a tri-skirt design, which allows the outer profile of the dispensing cap 14 to blend with the outer profile of the body 11. The dispensing cap 14 may be composed of any desired polymer or copolymer including PP, polycarbonate (PC), polyethylene terephthalate (PET), polyethylene (PE) and the like, and may be produced by any desired process including injection molding or the like. The dispensing cap 14 includes a base wall 30 having a circumferentially continuous exterior skirt 32 and a circumferentially continuous interior skirt 34 extending from the base wall 30. The skirts 32, 34 may include first and second radially inwardly extending helical thread segments or ridges 35 for engaging the corresponding external thread segments or ridges 26 of the body 11 so as to retain the dispensing cap 14 to the body 11. The dispensing cap 14 further includes an annular skirt 41 extending away from the base wall 30. A dispensing outlet 42 is provided in the base wall 30. Seated within the dispensing outlet 42 and facing the base wall 30 is an outlet valve arrangement 90 comprising, in this embodiment, an outlet valve 92 having an outlet valve flap 93 and an outlet valve retainer ring 94.

In certain embodiments, as shown in FIGS. 5A, 5B, 6A and 6B in an outlet valve flap 93 may be sectioned into two or more parts, such as the bisected flap 93 illustrated in FIGS. 5A, 5B, 6A and 6B which is hinged on both sides, allowing both parts of the valve flap to open and close from the midline of the outlet valve 92 rather than one side. One skilled in the art could also envision that an outlet valve flap could be sectioned in other ways, such as trisected. These may have an additional advantage of widening the product flowpath and/or reducing the force to dispense.

The outlet valve 92 is positioned between the annular skirt 41 and the outlet valve retainer ring 94. The outlet valve retainer ring 94 rests on the face of the outlet valve 92 opposite the annular skirt 41. The outlet valve 92 may be integral with or directly attached to the annular skirt 41, for example, by the use of adhesive and/or the outlet valve 92 may be held in position by the outlet valve retainer ring 94. The outlet valve retainer ring 94 may be interference fitted or snap-fit with the annular skirt seal 41 extending from the base wall 30, the interior skirt 34, or both and/or the outlet valve retainer ring 94 may be directly attached to the annular skirt 41 and/or interior skirt 34, for example, by the use of adhesive. In certain embodiments, as shown in FIGS. 2 and 3, to provide additional support to the retainer ring 94 the inner surface of the interior skirt 34 may have a notch 43 to accept the outer edge of the retainer ring 94. While a notch is illustrated in FIGS. 2 and 3 any other mechanism that could provide support to the retainer ring could be used, for example a ridge extending for the surface of the interior skirt, tabs, or adhesive. In certain embodiments the outlet valve retainer ring 94 may be substantially flat as shown in FIG. 4 or in certain other embodiments conical or funnel shaped as shown in FIGS. 5A, 5B, 6A and 6B to aid dispensing and minimize product residue. The outlet valve retainer ring opening 96 is smaller in diameter than the outlet valve flap 93. The outlet valve retainer ring 94 serves to hold the outlet valve flap 93 in place and the smaller diameter of the outlet valve retainer ring opening 96 prevents the outlet valve flap 93 from moving inwards towards the inner cavity 17 of the bottle 10. The inability of the outlet valve flap 93 to move inwards allows viscous liquid to exit the bottle and allows only a small portion of product to be pulled back towards the inside of the bottle when pressure on the bottle is released (this is generally positive for the user as it gives a neater cut-off), but prevents the intake of replacement air once the user is done squeezing, as the outlet valve flap 93 is prevented from moving upwards due to the outlet valve retainer ring 94. Therefore to return the inner cavity 17 of the bottle 10 to an equalized pressure replacement air must enter through a vent opening 116.

Figure 7:
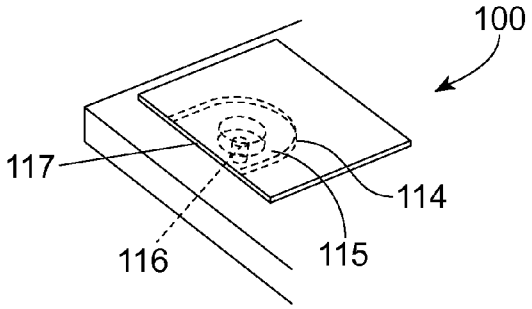
FIG. 7 is a perspective view of a vent opening and vent membrane according to an embodiment of the present invention.
Figure 8:
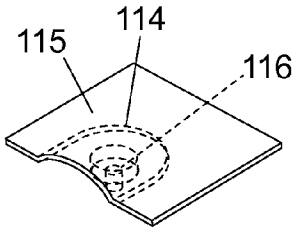
FIG. 8 is a perspective view of a vent opening and vent membrane shown in FIG. 7 when open.
Figure 9:
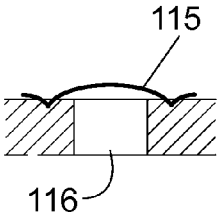
FIG. 9 is a sectional view of the vent opening and vent membrane shown in FIG. 7 when open.
Figure 10:
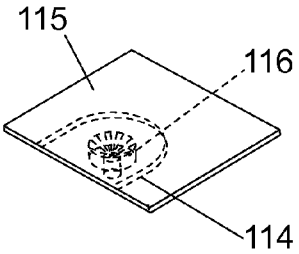
FIG. 10 is a perspective view of the vent opening and vent membrane shown in FIG. 7 when closed.
Figure 11:
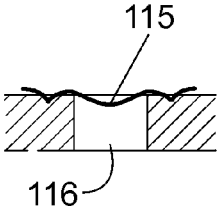
FIG. 11 is a sectional view of the vent opening and vent membrane shown in FIG. 7 when closed.

FIG. 7 is an enlarged view of a vent 100. While FIG. 7 illustrates a vent 100 comprising a flap type valve, other valves could be used, for example—duckbill valves, umbrella valves, minivalveballs, cross slit valves, and combination valves. FIG. 7 shows an embodiment in which a rectangular thin film check valve membrane 115 is placed so as to cover the channel 116 with an openable side of the check valve membrane 115 proximal to the channel 116 and opening on the side closest to the interior skirt 34. The thin film can be made from any desired polymer or copolymer film. The check valve membrane 115 can be fixed with a U-shaped adhesive bead 114 or heat sealed encircling the channel 116 except on one openable side 117. The check valve membrane 115, as shown in FIG. 3, should face the inner cavity 17 so that the replacement air is directed towards the interior skirt 34 and/or the inner surface of the finish portion 40 and side wall 38. The check valve membrane 115 opens on only one side as shown in FIG. 8 and FIG. 9, and the channel 116 is closed by the check valve membrane 115 as shown in FIG. 10 and FIG. 11. When viscous liquid is dispensed through the dispensing outlet 42 or when in the resting position the membrane 115 is pressed against the outlet valve retainer ring 94 and therefore closes the channel 116.

As illustrated in FIG. 3, dispensing cap 14 is shown in an open position with the cap lid 46 flexibly hinged to the base wall 30 at one side thereof by a hinge 48, but displaced from the base wall 30. As best shown in FIG. 2, the dispensing cap 14 includes an outlet seal 50 for sealing against the dispensing outlet 42 of the base wall 30 so as to seal the dispensing outlet 42 when the cap lid 46 is closed. The outlet seal 50 may be of any shape or size suitable to substantially seal the dispensing outlet 42. In addition, in this embodiment, the cap lid 46 includes a vent plug 47 for sealing the vent opening 33 in the base wall 30 when the cap lid 46 is secured. The vent plug 47 may be of any shape or size suitable to substantially seal the vent opening 33. The vent plug 47 may be made of the same material as the dispensing cap 14 or it may be made, at least in part, of different material, for example partially deformable material, such as thermoplastic Elastomers (TPE) such as block copolymers (styrenics, copolyesters, polyurethanes, polyamides) and TPE blends (thermoplastic polyolefins, thermoplastic vulcanizates) and alloys. Also, the back of the cap lid 46 partially defines the flat surface 15 of the dispensing cap 14 when closed.

Referring again to FIG. 3, one of ordinary skill in the art will recognize the advantageous functionality of the structure just previously described with respect to FIG. 7. With the present invention, it is now possible to vent replacement air into the inner cavity 17 of the bottle 10 while the bottle 10 is in its normal dispensing orientation as shown.

With reference to FIGS. 2 and 3, in the normal dispensing orientation, the viscous liquid 62 rests on the finish portion 20 of the body 11 and on the dispensing cap 14, and a head of air is trapped in the head space 54 between the viscous liquid 62 and the end wall 16 of the body 11. As mentioned previously, an advantage of such a bottle 10 is that the viscous liquid 62 contained therein is in close proximity to the discharge opening 42 and is thus continuously ready for quick dispensing without having to invert the bottle 10. To dispense the viscous liquid 62, a user applies pressure to the sidewall 18 of the bottle 10 to reduce the interior volume thereof, thereby compressing the head of air in the head space 54 to force the viscous liquid 62 out of the discharge opening 42. After each dispensing cycle, the user releases pressure from the sidewall 18 of the bottle 10, thereby partially enabling the resilient sidewall 18 to flex outwardly toward its original shape under the inherent resilient "memory" of the bottle 10. This creates a vacuum in the head space 54 that tends to pull the outlet valve flap 93 upwards, sealing the retainer ring opening 96, but leaving the vacuum in the inner cavity 17, causing the check valve membrane 115 to lift off of the vent channel 116 and draw a fresh charge of replacement air through the vent channel 116. The replacement air then travels along the interior skirt 34, inner surface of the finish portion 40, and the sidewall inner surface 38, and into the head space 54 behind the viscous liquid 62. As described below, the sidewall inner surface 38 is modified to allow the replacement air to travel along the sidewall inner surface 38. Thereafter, the user can close the cap lid 46 of the dispensing cap 14, and rest the bottle 10 on the flat base 15 of the dispensing cap 14 until the next use. In this way, the head space 54 is permitted to fill with replacement air after each dispensing cycle so that the inherent resiliency of the bottle sidewall 18 will return the bottle 10 to its freestanding original shape.

Figure 6A:
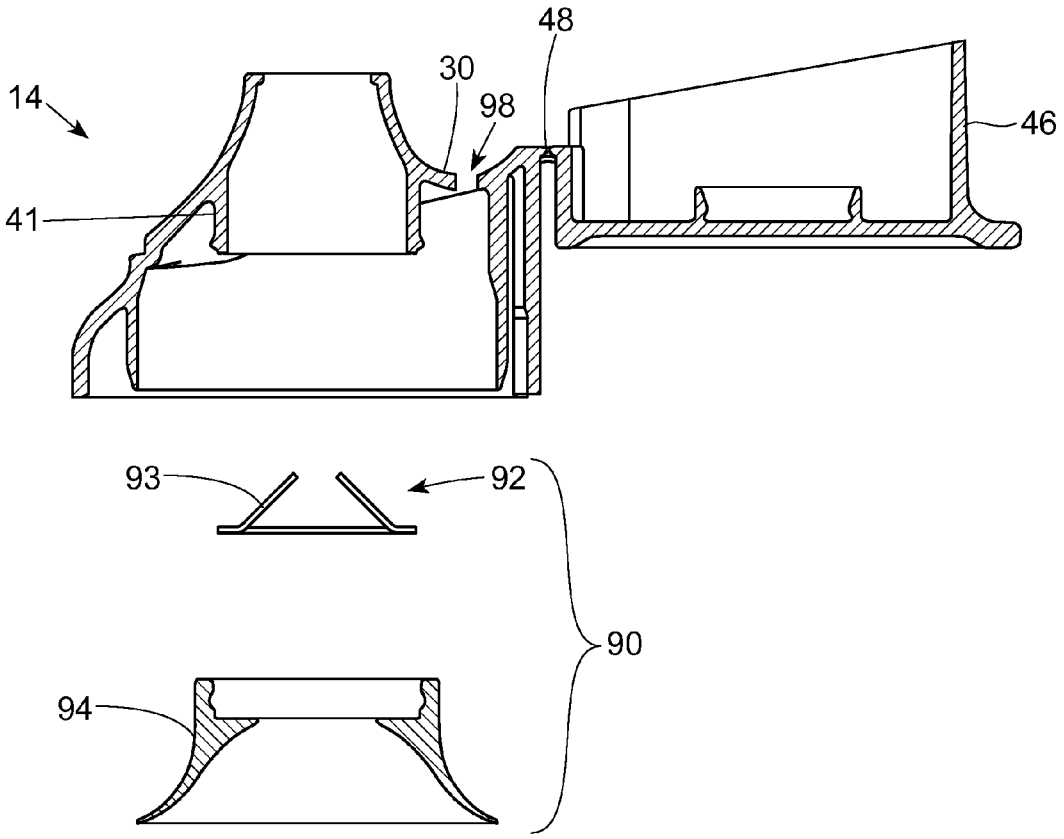
FIG. 6A is an exploded cross-sectional view of a dispensing valved cap and vent according to an embodiment of the present invention.
Figure 6B:
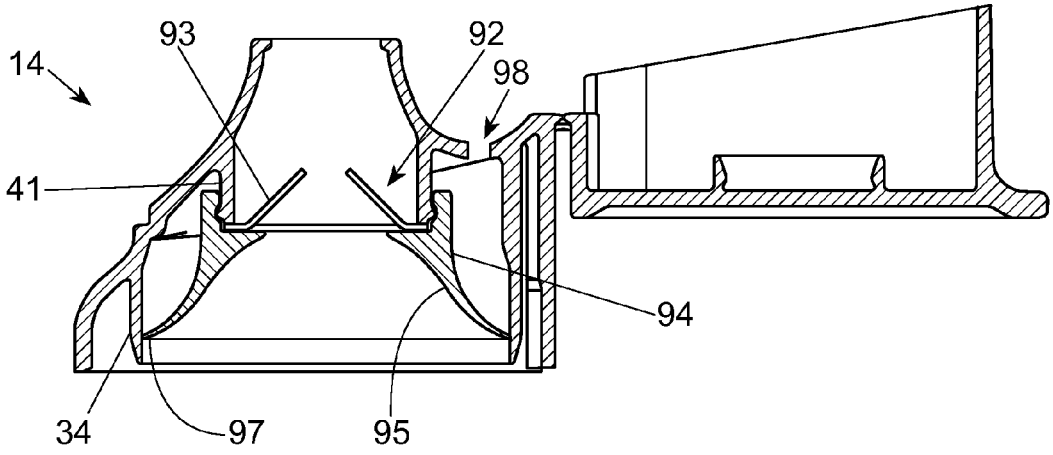
FIG. 6B is a cross-sectional view of a dispensing valved cap according to an embodiment of the present invention.

In certain embodiments, as shown in FIGS. 6A and 6B, an outlet valve retainer ring 94 does not include a replacement air vent, only an air channel opening 98. In this embodiment, the outlet valve retainer ring 94 wall is formed from materials and/or constructed such that it compresses and seals when the bottle is squeezed (such as a cup seal), as the viscous liquid presses against the outlet valve retainer ring bottom surface 95; and after dispensing the viscous liquid the outer rim 97 flexes inward toward cavity 17 when the bottle returns to its original shape after dispensing, as described previously the expanding volume of the bottle creates a vacuum, thereby allowing replacement air to enter the cap through the air channel opening 98 and bleed past the outlet valve retainer ring outer rim 97 and the interior skirt 34 anywhere along their mating surfaces. The replacement air then travels along the interior skirt 34 and inner surface of the finish portion 40, and the sidewall inner surface 38, and into the head space 54 behind the viscous liquid 62. To provide flexibility the outlet valve retainer ring may be constructed in any manner, for example by having a funnel or conical shape and/or an outer rim, to provide the flexibility to move, for example by having an elastic modulus in the range of about 16,000 psi to about 75,000 psi or from about 20,000 psi to about 40,000 psi, as the viscous liquid is being dispensed and afterwards as pressure is released. For instance, in certain embodiments the outer rim 97 may have a functional thickness from about 0.025 mm to about 0.38 mm or from about 0.076 mm to about 0.25 mm. Further, the outlet valve retainer ring may be formed from any material that can provide the desired flexibility, such as flexible plastics, for example low-density polyethylene (LDPE), polytetrafluoroethylene (PTFE) or polypropylene. This embodiment has the additional advantage of allowing replacement air to travel along the bottle inner surface without the complexity and cost associated with a vent.

Referring to FIG. 2, a bottle having improved product release 10 is illustrated for holding and dispensing a viscous liquid 62. Improved product release is provided by reducing the adhesion between the viscous liquid and the inner surface of the bottle. The reduction in adhesion can be delivered using one or a combination of modifications to the bottle inner surface, such as coating the inner surface with anti-adherence composition, incorporating an anti-adherence composition into the bottle, forming the bottle from a low surface energy material, or providing three dimensional structure to the inner surface, such as by imprinting or shaping the inner surface, or combinations thereof.

An anti-adherence composition can be a liquid, solid or both, in certain embodiments as shown in FIGS. 2 and 3 when the anti-adherence composition is a liquid it can be applied as a coating 57 to the inner surface of a bottle 10. In general the anti-adherence coating should be immiscible with the product. A coating 57 can be applied in effective amounts to inner surfaces 36, 38, 40 of the bottle 10 to maintain product stability and to provide increased viscous liquid evacuation. A coating 57 may also be applied to one or more of the retainer ring 94, outlet valve 93, annular skirt 41, interior skirt 34, or base wall 30. In certain embodiments, the coating may be applied to a predetermined coverage area that is less than the entire inner surface area of the bottle 10. As one of skill in the art would recognize, a variety of suitable anti-adherence coatings can be used that exhibit the general properties described above. Known anti-adherence materials that exhibit the requisite coating properties include, but are not limited to natural oils, silicone oils, and mineral oils. The natural oils are esters of glycerol and fatty acids; whereas, the mineral oils are hydrocarbon-based compounds and the silicone oils can be based on polyorganosiloxanes.

Examples of natural oils that are suitable in the present invention include, but are not limited to, a vegetable oil, such as olive oil, soybean oil, sunflower oil, canola oil and the like. In yet another form, the coating may include mixtures of soybean or canola oil combined with small amounts of lecithin (i.e., about 20 percent or less) and food grade alcohols (i.e., about 20 percent or less). Such alternative coatings are expected to provide similar results when applied to the bottle inner surface.

In the practice of the present invention, any relative amounts of bottle material and anti-adherence composition may be utilized that will provide the desired release property to the inner surface. In certain embodiments, the anti-adherence composition is provided to the bottle material in an effective amount to reduce residual viscous liquid remaining on an inner surface. The effective amount of anti-adherence composition will be selected upon consideration of the bottle material, the viscous liquid to be used therewith, economic factors, and engineering considerations.

In certain embodiments when an anti-adherence composition is incorporated into the body material, the body weight percent of anti-adherence composition, may generally comprise in the range of about 0.5 to about 20 weight percent anti-adherence composition, may comprise in the range of about 2 to about 20 weight percent anti-adherence composition, may comprise in the range of about 3 to about 15 weight percent anti-adherence composition, or may comprise in the range of about 3 to about 10 weight percent anti-adherence composition. The composition of the present invention may be formed by blending the anti-adherence composition with the plastic in molten form, or the anti-adherence composition may be compounded with the plastic. Examples of anti-adherence compositions that can be incorporated into the body material include ultra high molecular weight siloxane polymer, glycerol monostearate, erucamide.

In certain embodiments the bottles herein evacuate greater than 90 percent, greater than 95 percent, greater than 98 percent of the viscous liquid independent of bottle geometry.

In certain embodiments the coating composition may be uniformly applied to the predetermined coverage area in a thickness of about 0.003 inches or less.

Figure 12:
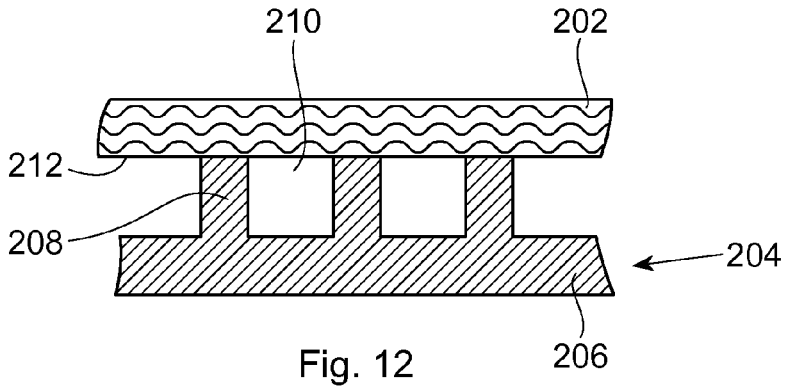
FIG. 12 is a schematic cross-sectional view a viscous liquid contacting an inner surface according to an embodiment of the present invention.

As described previously the inner surface of a bottle may have three dimensional structure, for example FIG. 12 is a schematic cross-sectional view of a contacting viscous liquid 202 in contact with a traditional non-wetting inner surface 204 (i.e., a gas impregnating surface), in accordance with one embodiment of the invention. The inner surface 204 includes a solid 206 having a surface texture defined by posts 208. The regions between the posts 208 are occupied by a gas 210, such as air. As depicted, while the contacting viscous liquid 202 is able to contact the tops of the posts 208, a gas-liquid interface 212 prevents the viscous liquid 202 from wetting the entire inner surface 204.

Figure 13:
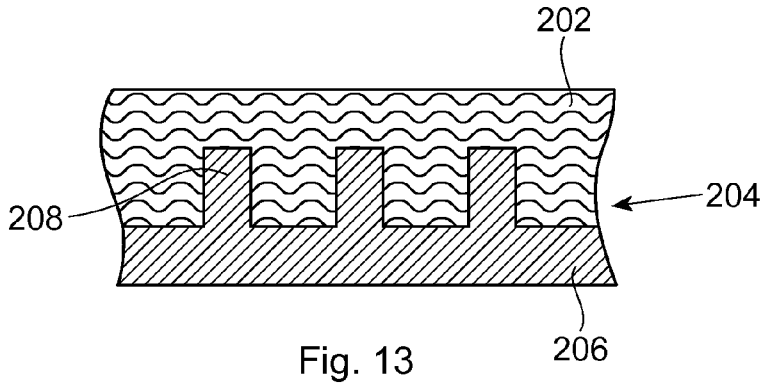
FIG. 13 is a schematic cross-sectional view of a viscous liquid that has impaled an inner surface according to an embodiment of the present invention.

Referring to FIG. 13, in certain instances, the contacting viscous liquid 202 may displace the impregnating gas and become impaled within the posts 208 of the solid 206. Impalement may occur, for example, when a liquid droplet impinges the inner surface 204 at high velocity. When impalement occurs, the gas occupying the regions between the posts 208 is replaced with the contacting viscous liquid 202, either partially or completely, and the inner surface 204 may lose its non-wetting capabilities.

Figure 14:
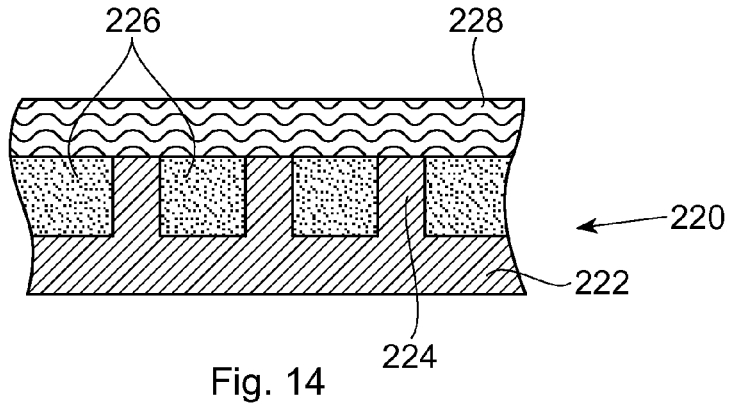
FIG. 14 is a schematic cross-sectional view of a viscous liquid in contact with a liquid impregnated inner surface according to an embodiment of the present invention.

Referring to FIG. 14, in certain embodiments, a non-wetting, liquid-impregnated inner surface 220 is provided that includes a solid 222 having textures (e.g., posts 224) that are impregnated with an impregnating liquid 226, rather than a gas. In the depicted embodiment, a contacting viscous liquid 228 in contact with the surface, rests on the posts 224 (or other texture) of the inner surface 220. In the regions between the posts 224, the contacting viscous liquid 228 is supported by the impregnating liquid 226. In certain embodiments, the contacting viscous liquid 228 is immiscible with the impregnating liquid 226. For example, the contacting viscous liquid 228 may be water and the impregnating liquid 226 may be oil.

Figure 15:
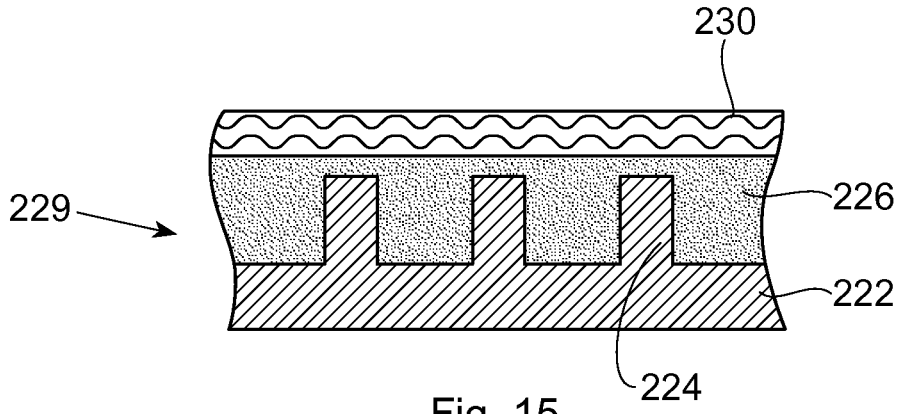
FIG. 15 is a schematic cross-sectional view of a viscous liquid in contacted with a liquid impregnated inner surface with excess impregnating liquid according to an embodiment of the present invention.

Referring to FIG. 15, in certain embodiments, a non-wetting, liquid-impregnated inner surface 229 is provided that includes a solid 222 having textures (e.g., posts 224) that are impregnated with an impregnating liquid 226, rather than a gas, and excess impregnating liquid 226 is applied such that the tops of the textured surface are substantially covered with the impregnating liquid 226. In the depicted embodiment, a contacting viscous liquid 230 is in contact with the excess impregnating liquid 226. In certain embodiments, the contacting viscous liquid 230 is immiscible with the impregnating liquid 226. For example, the contacting viscous liquid 230 may be water and the impregnating liquid 226 may be oil.

The textures within the liquid-impregnated inner surface 220 and 229 are physical textures or surface roughness. The textures may be random, including fractal, or patterned. In certain embodiments, the textures are micro-scale or nano-scale features. For example, the textures may have a length scale L (e.g., an average pore diameter, or an average protrusion height) that is less than about 100 microns, less than about 10 microns, less than about 1 micron, less than about 0.1 microns, or less than about 0.01 microns. In certain embodiments, the texture includes posts 224 or other protrusions, such as spherical or hemispherical protrusions. Rounded protrusions may be used in certain embodiments to avoid sharp solid edges and minimize pinning of liquid edges. The texture may be introduced to the surface using any conventional method, including mechanical and/or chemical methods such as lithography, self-assembly, imprinting, and deposition, for example.

The impregnating liquid 226 may be any type of liquid that is capable of providing the desired non-wetting properties. For example, the impregnating liquid 226 may be oil-based or water-based (i.e., aqueous). In certain embodiments, the impregnating liquid 226 is an ionic liquid (e.g., BMI-IM). Other examples of possible impregnating liquids include hexadecane, vacuum pump oils (e.g., FOMBLIN (Registered trademark) 06/6, KRYTOX (Registered trademark) 1506) silicone oils (e.g., 10 cSt or 1000 cSt), fluorocarbons (e.g., perfluoro-tripentylamine, FC-70), shear-thinning fluids, shear-thickening fluids, liquid polymers, dissolved polymers, viscoelastic fluids, and/or liquid fluoroPOSS. In certain embodiments, the impregnating liquid is (or comprises) a liquid metal, a dielectric fluid, a ferro fluid, a magneto-rheological (MR) fluid, an electro-rheological (ER) fluid, an ionic fluid, a hydrocarbon liquid, and/or a fluorocarbon liquid. In one embodiment, the impregnating liquid 226 is made shear thickening with the introduction of nano particles. A shear-thickening impregnating liquid 226 may be desirable for preventing impalement and resisting impact from impinging liquids, for example.

The impregnating liquid 226 may be introduced to the inner surface 220 or 229 using any conventional technique for applying a liquid to a solid. In certain embodiments, a coating process, such as a dip coating, blade coating, or roller coating, is used to apply the impregnating liquid 226. Alternatively, the impregnating liquid 226 may be introduced and/or replenished by liquid materials flowing past the inner surface 220 or 229 (e.g., in a pipeline). After the impregnating liquid 226 has been applied, capillary forces hold the liquid in place. Capillary forces scale roughly with the inverse of feature-to-feature distance or pore radius, and the features may be designed such that the liquid is held in place despite movement of the surface and despite movement of air or other fluids over the surface. Small features may also be useful to provide robustness and resistance to impact.

Compared to gas-impregnated surfaces, the liquid-impregnated surfaces described herein offer several advantages. For example, because liquids are incompressible over a large range of pressures, liquid-impregnated surfaces are generally more resistant to impalement. In certain embodiments, while nano-scale (e.g., less than one micron) textures may be necessary to avoid impalement with gas-impregnated surfaces, micro-scale (e.g., from 1 micron to about 100 microns) textures are sufficient for avoiding impalement with liquid-impregnated surface. As mentioned, micro-scale textures are much easier to manufacture and more practical than nano-scale textures.

Liquid-impregnated surfaces are also useful for reducing viscous drag between a solid surface and a flowing liquid. In general, the viscous drag or shear stress exerted by a liquid flowing over a solid surface is proportional to the viscosity of the liquid and the shear rate adjacent to the surface. A traditional assumption is that liquid molecules in contact with the solid surface stick to the surface, in a so-called "no-slip" boundary condition. While some slippage may occur between the liquid and the surface, the no-slip boundary condition is a useful assumption for most applications.

In certain embodiments, non-wetting surfaces, such as liquid-impregnated surfaces, are desirable as they induce a large amount of slip at the solid surface. For example, referring again to FIGS. 12-15, when a contacting liquid 202, 228, 230 is supported by an impregnating liquid 226 or a gas, the liquid-liquid or liquid-gas interface is free to flow or slip with respect to the underlying solid material. Drag reductions of as much as 40% may be achieved due to this slippage. As mentioned, however, gas-impregnated surfaces are susceptible to impalement. When impalement occurs with a gas-impregnated surface, the benefits of reduced drag reduction may be lost.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A squeeze bottle comprising:

a body having an end wall, side wall, and finished portion forming an inner cavity having an inner surface;

a dispensing cap having a cap lid, a dispensing outlet, an exterior skirt, an interior skirt, an annular skirt, base wall, and a vent channel; an outlet valve arrangement;

wherein the inner cavity contains a viscous liquid and includes a headspace positioned between the viscous liquid and the end wall;

wherein the dispensing outlet, inner surface, interior skirt, annular skirt, and base wall are modified with an anti-adherence coating to reduce adhesion between the dispensing outlet, inner surface, interior skirt, annular skirt, base wall, and the viscous liquid;

the anti-adherence coating is at least one of natural oils, silicone oils, or mineral oils;

wherein the vent channel is positioned between the interior skirt and the annular skirt, such that replacement air drawn through the vent channel travels along the interior skirt and the inner cavity inner surface to the head space;

wherein the vent channel comprises a vent having a check valve membrane; and wherein the check valve membrane allows replacement air to enter the vent channel and prevents viscous liquid from the inner cavity entering the vent channel.

2. The squeeze bottle of claim 1, wherein the cap lid comprises a vent plug.

3. The squeeze bottle of claim 1, wherein the outlet valve arrangement comprises an outlet valve having an outlet valve flap and an outlet valve retainer ring having an outlet valve retainer ring opening.

4. The squeeze bottle of claim 3, wherein the outlet valve flap is sectioned into two or more parts.

5. The squeeze bottle of claim 3, wherein the outlet valve retainer ring comprises a vent in fluid communication with at least one of the vent opening or the inner cavity.

6. The squeeze bottle of claim 3, wherein the outlet valve retainer ring opening is smaller in diameter than the outlet valve flap.

7. A squeeze bottle comprising:

a body having an end wall, side wall, and finished portion forming an inner cavity having an inner surface;

a dispensing cap having a cap lid, a dispensing outlet, an exterior skirt, an interior skirt, an annular skirt, base wall, and vent-channel;

an outlet valve having an outlet valve flap and a flexible outlet valve retainer ring having an outlet valve retainer ring opening;

wherein the inner cavity contains a viscous liquid and includes a headspace positioned between the viscous liquid and the end wall;

wherein the dispensing outlet, inner surface, interior skirt, annular skirt, and base wall are modified with an anti-adherence coating to reduce adhesion between the dispensing outlet, inner surface, interior skirt, annular skirt, base wall, and the viscous liquid;

the anti-adherence coating comprises a three-dimensional structure raised above the inner surface forming gaps with an impregnating liquid in and above the gaps;

wherein the vent channel is positioned between the interior skirt and the annular skirt, such that replacement air drawn through the vent channel travels along the interior skirt and the inner cavity inner surface to the head space;

wherein the vent channel comprises a vent having a check valve membrane; and wherein the check valve membrane allows replacement air to enter the vent channel and prevents viscous liquid from the inner cavity entering the vent channel.

8. The squeeze bottle of claim 7, wherein the flexible outlet valve retainer ring has a conical shape.

9. The squeeze bottle of claim 7, wherein the flexible outlet valve retainer ring is positioned under the outlet valve and around the annular skirt.

10. A method of dispensing a viscous liquid comprising: providing a squeeze bottle comprising:

a body having an end wall, side wall, and finished portion forming an inner cavity having an inner surface;

a dispensing cap having a cap lid, a dispensing outlet, an exterior skirt, an interior skirt, an annular skirt, base wall, and a vent channel having a check valve membrane;

an outlet valve having an outlet valve flap and an outlet valve retainer ring having an outlet valve retainer ring opening; viscous liquid;

wherein the inner cavity contains a viscous liquid and includes a headspace positioned between the viscous liquid and the end wall;

wherein the dispensing outlet, inner surface, interior skirt, annular skirt, and base wall are modified with an anti-adherence coating to reduce adhesion between the dispensing outlet, inner surface, interior skirt, annular skirt, base wall and the viscous liquid;

the anti-adherence coating is at least one of natural oils, silicone oils, mineral oils, or a three-dimensional structure raised above the inner surface forming gaps with an impregnating liquid in and above the gaps;

applying pressure to the squeeze bottle to open the valve flap and dispense the viscous liquid;

preventing the viscous liquid present in the inner cavity from entering the vent channel by the check valve membrane pressing against the outlet valve retainer ring and closing the vent channel;

releasing the pressure and closing the valve flap; and drawing replacement air through the vent channel and opening the check valve membrane allowing the replacement air to travel along the interior skirt and inner cavity inner surface to the head space.

11. The squeeze bottle of claim 1, wherein the interior skirt has an outer surface that is in contact with an inner surface of the finished portion.

* * * * *